US006151928A

United States Patent [19]

Anyon et al.

[11] Patent Number: 6,151,928

[45] Date of Patent: Nov. 28, 2000

[54] TEXTILE FABRIC

[75] Inventors: David S. Anyon, Hillsburgh, Ontario; Kin So, Guelph, Ontario, both of Canada

[73] Assignee: Vintex, Inc., Mount Forest, Canada

[21] Appl. No.: 09/058,510

[22] Filed: Apr. 10, 1998

[30] Foreign Application Priority Data

Feb. 12, 1997 [CA] Canada ..... 2223120

[51] Int. Cl.[7] ..... D04B 11/04

[52] U.S. Cl. ..... 66/196; 66/193; 66/195

[58] Field of Search ..... 66/196, 201, 202; 428/109, 111, 195, 196, 197

[56] References Cited

U.S. PATENT DOCUMENTS

| | | | |
|---|---|---|---|
| 5,413,837 | 5/1995 | Rock et al. | 428/192 |
| 5,422,153 | 6/1995 | Miyamoto | 428/95 |
| 5,651,847 | 7/1997 | Loeffler | 156/71 |

*Primary Examiner*—John J. Calvert
*Assistant Examiner*—Robert H. Muromoto, Jr.
*Attorney, Agent, or Firm*—Pearne & Gordon LLP

[57] ABSTRACT

A knitted fabric comprises a layer of hydrophillic yarn on one face of the fabric, a layer of hydrophobic yarn on the opposite face of the fabric. A pillar stitched, low density layer of yarn extends between and joins the hydrophillic and hydrophobic yarn layers.

16 Claims, 5 Drawing Sheets

= Knit

= Tuck

H= High Needle
L= Low Needle

= Knit

= Tuck

H= High Needle
L= Low Needle

= Knit

= Tuck

H= High Needle
L= Low Needle

TEXTILE FABRIC

FIELD OF THE INVENTION

The present invention relates to the field of textile fabrics, and to methods of manufacturing same. In particular, the present invention provides a novel knitted fabric heaving good moisture absorption capabilities, combined with excellent breathability and a dry touch.

BACKGROUND OF THE INVENTION

The fabric of the present invention is particularly suited to applications in which it is desired to provide a body-contacting fabric surface covering a moisture absorbing layer. A typical product requiring such a combination is a bed pad, or an incontinence garment. Conventionally, fabrics for these products have been manufactured by quilting together a face fabric such as a hydrophobic polyester knit and a soaker layer such as a non-woven hydrophillic needlepunch. Material manufactured in this way is capable of absorbing a large amount of moisture, but does not feel dry to the touch, because the face fabric, while hydrophilic, lies directly on the soaker material. Accordingly, if the soaker material is saturated, a wet feel will be transmitted to the surface of the face fabric. Moreover, such quilted material is costly to manufacture since it requires two separate manufacturing processes, one for each of the soaker and the face materials, and a separate quilting operation.

There have been attempts made, in the textile industry, to provide a fabric with a hydrophilic face and a hydrophillic face, thereby to produce a material capable of absorbing a significant quantity of moisture, while remaining dry to the touch. In U.S. Pat. No. 5,065,600 (Byles) a textile fabric with opposed absorbent and non-absorbent layers is described, which comprises a hydrophilic yarn formed in a raised surface construction at one face of the fabric, and a hydrophilic yarn formed in a dense extended pile at the opposite face of the fabric, and a ground yarn between these two layers formed in a dimensionally stable construction. Dry feel is provided by the raised surface construction of the hydrophilic yarn layer. The disadvantage of such a construction, however, is that it does not provide a significant volume in association with the hydrophilic yarn layer, because the ground yarn layer is relatively flat. Accordingly, moisture accumulating in the hydrophillic layer may tend to migrate to the hydrophilic layer, especially if subjected to tactile pressure.

Other knitted fabrics attempting to take advantage of the different properties of hydrophilic and hydrophillic yarns or filaments and/or yarns of varying denier are described in Canadian Patent No. 2,170,976 and U.S. Pat. No. 4,733,546. Knitted fabrics utilizing a stitch that spaces apart a front and back face of a fabric for providing an insulating layer or high loft feel to a fabric are described in Canadian Patent No. 2,115,505 and U.S. Pat. No. 5,385,036. The prior art does not, however, describe a knit fabric with a hydrophilic face spaced from a hydrophobic face by low density columnar stitches extending between the two faces to provide a relatively voluminous space between the two for water retention and air circulation.

The object of the present invention, therefore, is to provide a lightweight, highly absorbent knitted fabric.

A further object is to provide a knitted fabric with a highly absorbent, hydrophilic face, and a dry feeling hydrophobic face, spaced apart from one another by a low density, but relatively thick layer of columnar stitches. The low density layer of columnar stitches provides a space for air circulation between the hydrophilic and hydrophobic faces, and provides additional space for retention of excess moisture when the holding capacity of the hydrophilic layer is completely utilized. In this way, even at full capacity for holding moisture, the hydrophobic dry face of the fabric is held out of contact with the accumulated moisture, and will maintain a dry feel to the touch.

In a broad aspect, then, the present invention relates to a knitted fabric comprising a layer of hydrophilic yarn on one face of said fabric, a layer of hydrophilic yarn on the opposite face of said fabric, and a pillar stitched, low density layer of yarn extending between and joining said hydrophillic and hydrophilic yarn.

BRIEF DESCRIPTION OF THE DRAWINGS

In drawings that illustrate the present invention by way of example.

DETAILED DESCRIPTION

Figure 1:
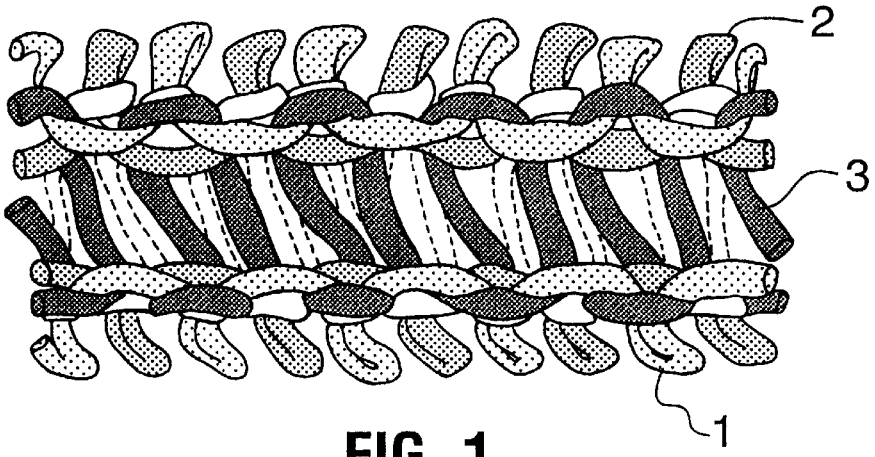
FIG. 1 is a cross-sectional view of a fabric according to the present invention.
Figure 2:
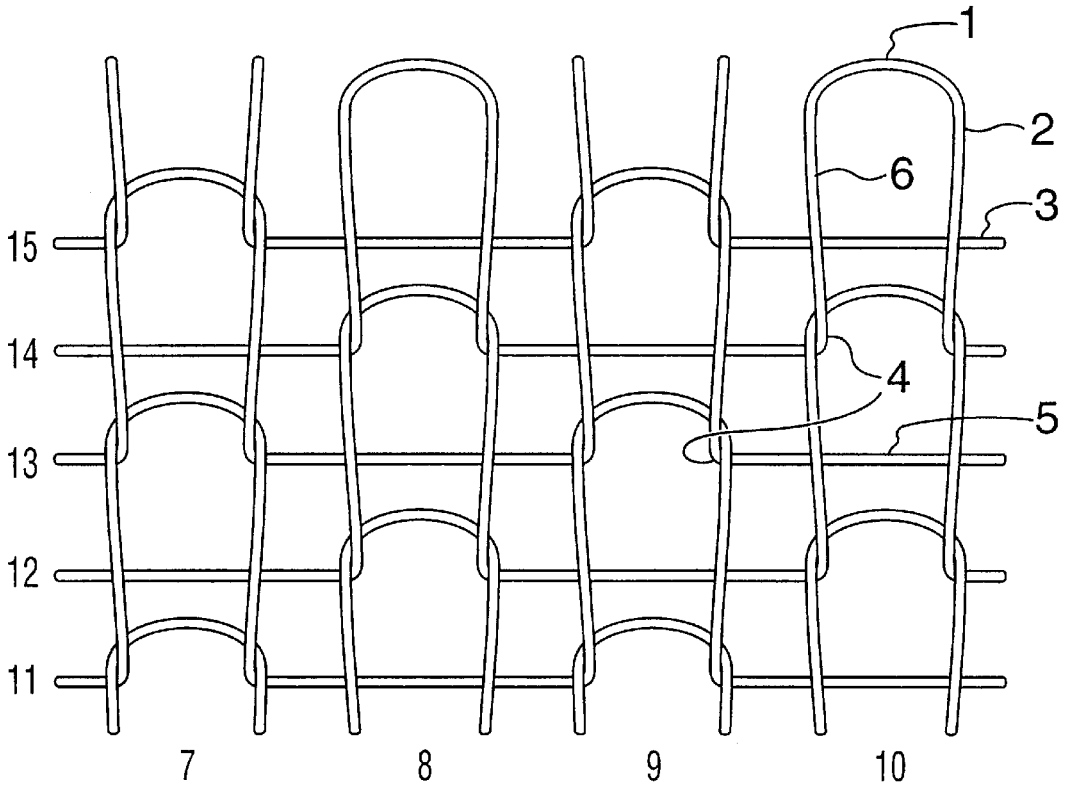
FIG. 2 is a top view of the technical front of the fabric of the present invention.

Referring to FIGS. 1 and 2, the basic three dimensional structure of the fabric of the present invention is illustrated. The fabric comprises a hydrophobic technical back face 2, made from hydrophobic yarn such as a 1/150/34 denier textured polyester. The selection of a suitable hydrophobic yarn is considered a matter of choice for one skilled in the art.

The technical front face 1 is a hydrophilic yarn, such as a 1/150/200 denier textured polyester yarn. The selection of a suitable hydrophilic yarn is also considered a matter of choice for one skilled in the art.

The technical front 1 and back 2 are joined by a layer 3 of tuck stitches in a pillar arrangement as illustrated. The pillar tuck stitches are made from a 1/220/60 denier flat polyester yarn, or such other suitable yarn, as will be an obvious matter of choice to one skilled in the art and apprised of the teaching of the present application.

Figure 3A:
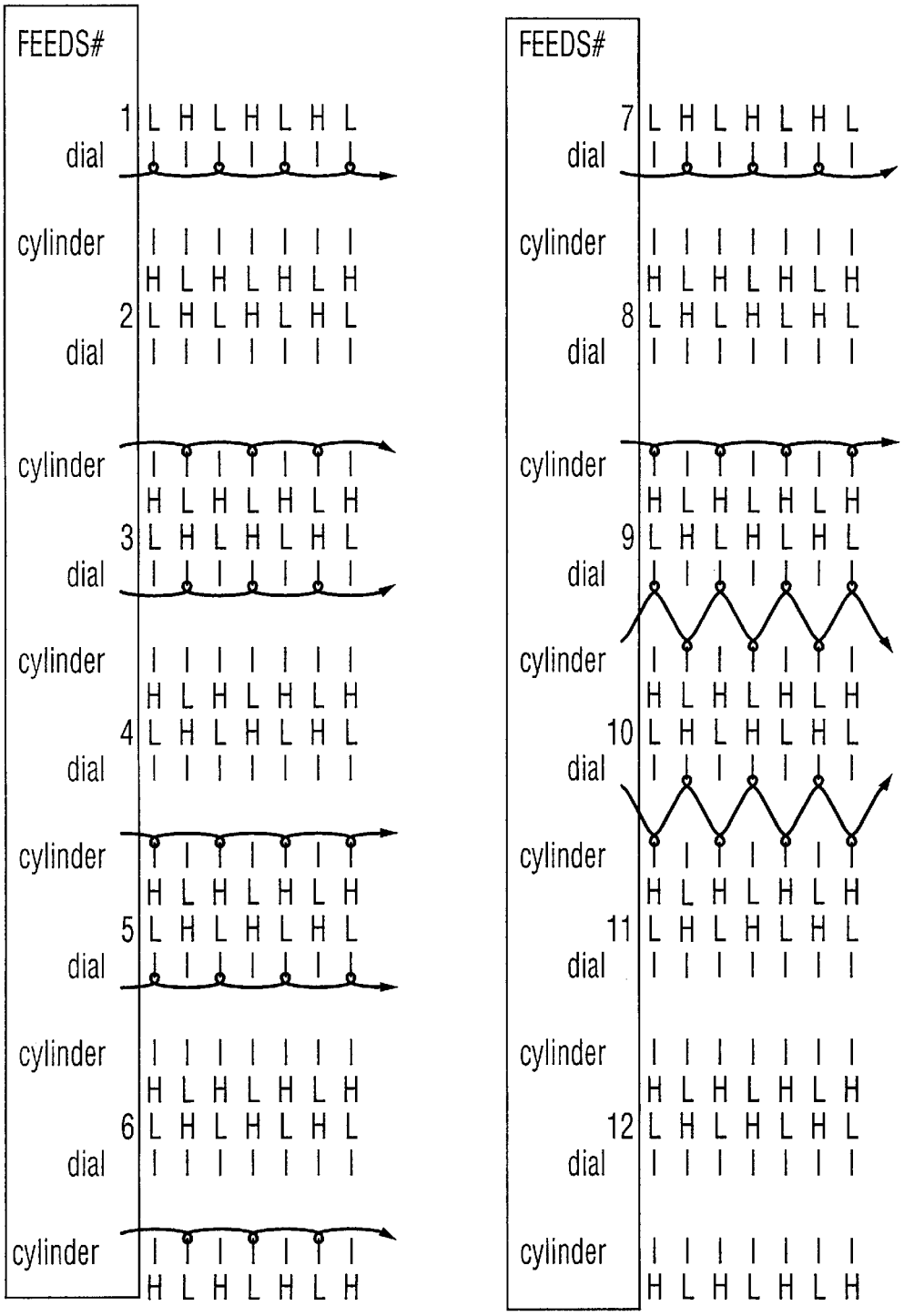
FIGS. 3*a*, 3*b* and 3*c* are stitch pattern diagrams for three exemplary embodiments of the present invention.
Figure 3A:
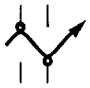
Figure 3A:
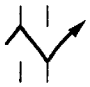
Figure 3B:
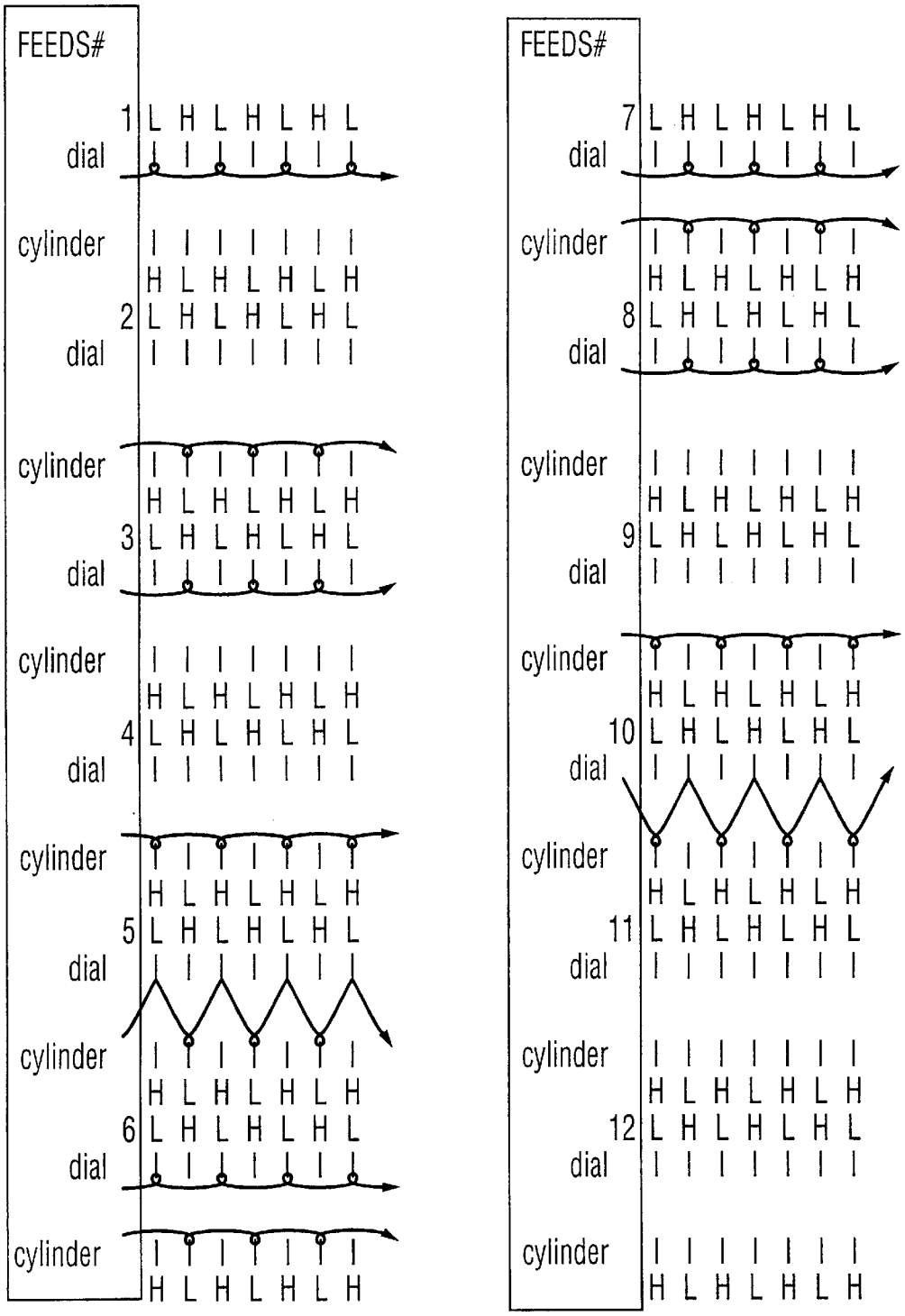
Figure 3B:
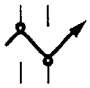
Figure 3B:
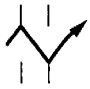
Figure 3C:
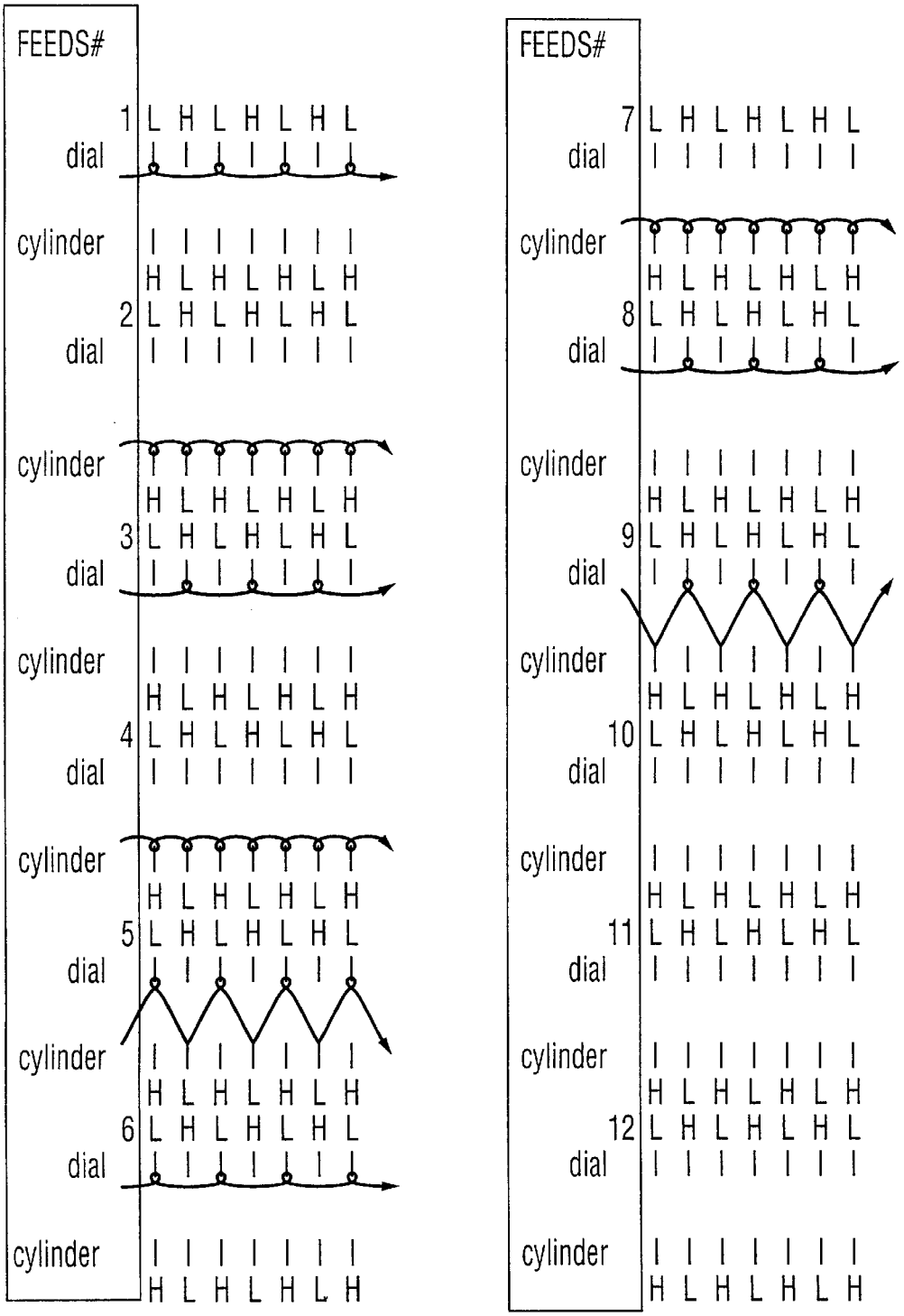
Figure 3C:
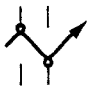
Figure 3C:
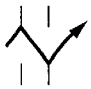

The fabric of the present invention is knit on a circular knitting machine such as an FDR Rib machine, with a thirty inch diameter, 1320 needles, 6 feeds and 14 cuts. A typical knitting pattern to produce the fabric of the present invention will be:

Feed #1: Tuck all long butt needles, dial and cylinder;

Feed #1: Knit all long butt needles; dial only;

Feed #3: Knit all long butt needle; cylinder only;

Feed #4: Knit all short butt needles; dial only;

Feed #5: Knit all short butt needles; cylinder only;

repeated, with five courses per repeat, twelve courses per revolution, with the machine identified. FIGS. 3*a*, 3*b* and 3*c* illustrate diagrammatically other patterns that may be utilized to produce the fabric of the present invention.

Figure 4:
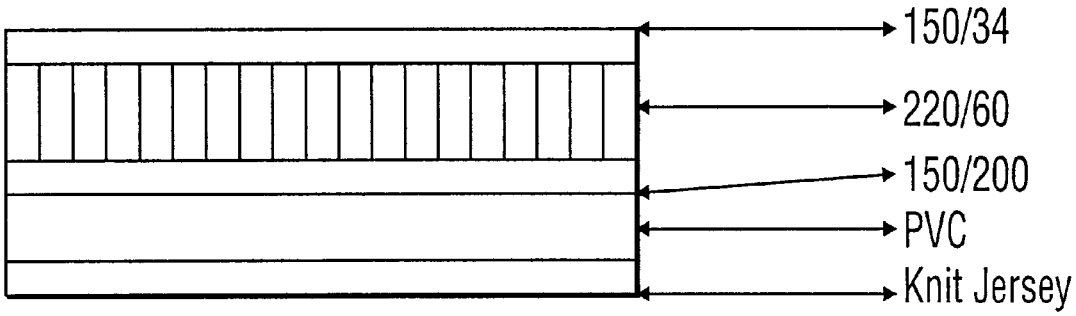
FIG. 4 is a cross-sectional view of an incontinent pad utilizing the fabric of the present invention, coated with PVC.

Referring to FIG. 4, a preferred use of the fabric of the present invention is illustrated. After the fabric of the present invention is knit, following the examples cited above, or other patterns that will be obvious to one skilled in the art who is apprised of the present invention, it is hot air tentered under no tension, and then coated on its technical front (hydrophilic layer) with PVC or any other suitable waterproof polymer, following which a finishing layer, for instance of knit jersey is applied to the face of the PVC. This combination is eminently suited for the manufacture of bed pads, or incontinence garments, where a water proof layer, such as will be provided by the PVC, is desired.

Other uses for the fabric of the present invention include use as a thermally insulating fabric. In this regard, the fabric is especially useful for sportswear for use in active winter sports like cross country skiing. This type of sport will cause a participant to perspire freely even at very low temperatures like −15° C. It is very desirable to wick perspiration from the skin before it causes chills. Moreover, the fabric of the present invention will permit perspiration to be removed while at the same time allowing air to circulate in the middle, pillar stitch layer of the fabric, keeping the wearer warm and well ventilated.

The fabric of the present invention also has potential uses in protective clothing, medical garments, footwear liners and socks, bedding and filtration.

It is to be understood that the examples described above are not meant to limit the scope of the present invention. It is expected that numerous variants will be obvious to the person skilled in the field of knitting and fabric engineering without any departure from the spirit of the invention. The appended claims, properly construed, form the only limitation upon the scope of the invention.

What is claimed is:

1. A knitted fabric comprising a layer of hydrophilic yarn on one face of said fabric, a layer of hydrophobic yarn on the opposite face of said fabric, a pillar stitched, low density layer of yarn extending between and joining said hydrophilic and hydrophobic yarn, a layer of waterproof plastic material coated on said hydrophilic layer, and a layer of knit jersey material applied to the face of said waterproof material.

2. A fabric as claimed in claim 1, wherein said layer of hydrophilic yarn is on the technical front of said fabric.

3. A fabric as claimed in claim 1, wherein said layer of hydrophobic yarn is on the technical back of said fabric.

4. A fabric as claimed in claim 1, wherein said pillar stitched layer of yarn is a flat yarn.

5. A fabric as claimed in claim 1, wherein said hydrophilic yarn is 1/50/200 denier, textured yarn.

6. A fabric as claimed in claim 1, wherein said hydrophobic yarn is 1/150/200 denier textured polyester yarn.

7. A fabric as claimed in claim 1, wherein said pillar stitched yarn is 1/220/60 denier flat polyester yarn.

8. A knitted fabric comprising a layer of hydrophilic yarn on one face of said fabric, a layer of hydrophobic yarn on the opposite face of said fabric, a pillar stitched, low density layer of yarn extending between and joining said hydrophilic and hydrophobic yarn, a layer of waterproof plastic material coated on said hydrophilic layer and a layer of knit jersey material applied to the face of said waterproof material, wherein said waterproof material is polyvinyl chloride (PVC).

9. An incontinence garment or bed pan manufactured with a knitted fabric comprising a layer of hydrophilic yarn on one face of said fabric, a layer of hydrophobic yarn on the opposite face of said fabric, and a pillar stitched, low density layer of yarn extending between and joining said hydrophillic and hydrophilic yarn, wherein a layer of waterproof plastic material is coated on said hydrophilic layer.

10. A garment, footwear liner, filter, sheet or incontinent appliance manufactured with a knitted fabric comprising a layer of hydrophilic yarn on one face of said fabric, a layer of hydrophobic yarn on the opposite face of said fabric, and a pillar stitched, low density layer of yarn extending between and joining said hydrophilic and hydrophobic yarn.

11. A fabric as claimed in claim 2, wherein said pillar stitched layer of yarn is a flat yarn.

12. A fabric as claimed in claim 2, wherein said hydrophilic yarn is 1/150/200 denier, textured polyester yarn.

13. A fabric as claimed in claim 2, wherein said hydrophobic yarn is 1/150/200 denier textured polyester yarn.

14. A fabric as claimed in claim 2, wherein said pillar stitched yarn is 1/220/60 denier flat polyester yarn.

15. A knitted fabric comprising a layer of hydrophilic yarn on one face of said fabric, a layer of hydrophobic yarn on the opposite face of said fabric, a pillar stitched, low density layer of yarn extending between and joining said hydrophilic and hydrophobic yarn, a layer of waterproof plastic material coated on said hydrophilic layer and a layer of knit jersey material applied to the face of said waterproof material, wherein said layer of hydrophilic yarn is on the technical front of said fabric.

16. A fabric as claimed in claim 15, wherein said waterproof material is polyvinyl chloride (PVC).

* * * * *

UNITED STATES PATENT AND TRADEMARK OFFICE

CERTIFICATE OF CORRECTION

PATENT NO. : 6,151,928

DATED : November 28, 2000

INVENTOR(S) : David S. Anyon, et al.

It is certified that error appears in the above-indentified patent and that said Letters Patent is hereby corrected as shown below:

Column 1 line 18, delete "hydrophillic" and insert therefore --hydrophilic--.

Column 1 line 21, delete "hydrophilic" and insert therefore --hydrophobic--.

Column 1 line 29, delete "hydrophilic" and insert therefore --hydrophobic--.

Column 1 line 29, delete "hydrophillic" and insert therefore --hydrophilic--.

Column 1 line 34, delete "hydrophilic" and insert therefore --hydrophobic--.

Column 1 line 40, delete "hydrophilic" and insert therefore --hydrophobic--.

Column 1 line 44, delete "hydrophillic" and insert therefore --hydrophilic--.

UNITED STATES PATENT AND TRADEMARK OFFICE

CERTIFICATE OF CORRECTION

PATENT NO. : 6,151,928
DATED : November 28, 2000
INVENTOR(S) : David S. Anyon, et al.

It is certified that error appears in the above-indentified patent and that said Letters Patent is hereby corrected as shown below:

Column 1 line 45, delete "hydrophilic" and insert therefore --hydrophobic--.

Column 1 line 48, delete "hydrophilic" and insert therefore --hydrophobic--.

Column 1 line 48, delete "hydrophillic" and insert therefore --hydrophilic--.

Column 2 line 10, delete "hydrophilic" and insert therefore --hydrophobic--.

Column 2 lines 10-11, delete "hydrophillic" and insert therefore --hydrophilic--.

Column 2 line 13, delete "hydrophilic" and insert therefore --hydrophobic--.

Claim 5 line 2, delete "1/50/200" and insert therefore --1/150/200--.

Signed and Sealed this

Twenty-second Day of May, 2001

Nicholas P. Godici

*Attest:*

NICHOLAS P. GODICI

*Attesting Officer*

*Acting Director of the United States Patent and Trademark Office*